United States Patent [19]

Itiki et al.

[11] Patent Number: 4,820,227

[45] Date of Patent: Apr. 11, 1989

[54] METHOD AND APPARATUS FOR SUPPORTING CATHODE-RAY TUBE PANEL

[75] Inventors: Hidetoshi Itiki, Himeji; Yoshihisa Kozasa, Hyogo, both of Japan

[73] Assignee: Kabushiki Kaisha Toshiba, Kawasaki, Japan

[21] Appl. No.: 39,282

[22] Filed: Apr. 17, 1987

[30] Foreign Application Priority Data

Apr. 18, 1986 [JP] Japan ..... 61-89498

[51] Int. Cl.[4] ..... H01J 9/22

[52] U.S. Cl. ..... 445/66; 445/68

[58] Field of Search ..... 445/66, 68, 71, 58

[56] References Cited

U.S. PATENT DOCUMENTS

| | | | |
|---|---|---|---|
| 2,564,897 | 8/1951 | Hahn | 445/66 |
| 4,138,774 | 2/1979 | Oyama | 445/68 |
| 4,188,695 | 2/1980 | Oyama | 445/66 |
| 4,317,427 | 3/1982 | Turner . | |
| 4,406,638 | 9/1983 | DeAngelis | 445/68 |
| 4,451,242 | 5/1984 | Miyazawa et al. | 445/68 |
| 4,451,243 | 5/1984 | D'Augustine et al. | 445/68 |
| 4,573,935 | 3/1986 | Wardell, Jr. | 445/66 |

FOREIGN PATENT DOCUMENTS

| | | | |
|---|---|---|---|
| 57-97359 | 12/1980 | Japan . | |
| 0152342 | 9/1983 | Japan | 445/66 |

*Primary Examiner*—Kurt Rowan

*Attorney, Agent, or Firm*—Cushman, Darby & Cushman

[57] ABSTRACT

An apparatus for supporting a cathode-ray tube panel includes a pair of holders movable to come close to each other and to be separated from each other. Each holder includes elastic rollers. The panel is located between the rollers of the pair of holders. After the panel is located between the rollers of the holders, the holders are moved to a surfaces of the panel. The rollers of the holders are brought into contact with the surfaces of the panel. The holders are interlocked with an actuator. The actuator is interlocked with a lock plate through a ratchet mechanism. The holders can freely come close to each other by the ratchet mechanism although the lock plate is not pivoted. The holders can be brought into contact with panels having different sizes. In a contact state, the actuator locked with the lock plate through the ratchet mechanism is pivoted by a predetermined angle so as to cause the holders to come closer to each other. When the holders are thus moved, they are locked. Therefore, the rollers of the holders are kept in tight contact with the surfaces of the panel and are elastically deformed. The panel can be held at a constant contact pressure corresponding to the pivot angle.

8 Claims, 5 Drawing Sheets

METHOD AND APPARATUS FOR SUPPORTING CATHODE-RAY TUBE PANEL

BACKGROUND OF THE INVENTION

1. Field of the Art

The present invention relates to a method and apparatus for supporting various types of cathode-ray tube panels.

2. Background of the Prior Art

In the process for fabricating cathode-ray tubes, in order to form a phosphor screen on the inner surface of a cathode-ray tube panel, the panel is rotated to uniformly disperse a liquid phosphor while the liquid phosphor is supplied to the inner surface of the panel. In this case, a panel support apparatus is used to firmly hold the panel so as to prevent the panel from being dropped during its rotation.

A conventional panel support apparatus of this type comprises a pair of holders designed for each panel size, or two pairs of holders, each pair designed for a specific size. The latter apparatus is described in Japanese Utility Model Publication No. 60-3485.

Either support apparatus is designed for a specific size. For this reason, when various types of cathode-ray tubes having different panel sizes are to be fabricated, all panel support apparatuses in the production line must be replaced with apparatuses which are compatible with the desired size. Changes in a production line cannot be easily made. In addition, panel support apparatuses having sizes corresponding to all possible panel sizes must be prepared. Furthermore, one production line is limited to fabricating only the cathode-ray tube panels having a single size.

As is apparent from the above description, conventional panel support apparatuses can be used in production lines for panels having a single size or two different sizes. It is, therefore, difficult to use them in a production line for many different panel sizes.

SUMMARY OF THE INVENTION

It is an object of the present invention to provide a method and apparatus for firmly supporting cathode-ray tube panels having different sizes in a relatively simple, compact, lightweight structure.

According to an aspect of the present invention, there is provided an apparatus for individually supporting cathode-ray tube panels of different sizes, whose panel surfaces face each other, which comprises a pair of holders adapted to come close to each other and to be separated from each other, transporting means for positioning the panel between said pair of holders, moving means for moving said pair of holders to the panel surfaces after the panel is moved to a position between said pair of holders by said transporting means, and urging means for moving said pair of holders, which have been moved to the surfaces by said moving means, to come close to each other by a predetermined distance regardless of the size of the panel, thereby urging said pair of holders against the surfaces of the panel and hence causing said pair of holders to hold the panel.

According to the present invention, a panel is located between a pair of holders, and the holders are moved to the surfaces of the panel. The holders are then moved to come close to each other by a predetermined distance regardless of the size of the panel. The holders abut against the side surfaces of the panel and firmly hold the panel. Therefore, an urging means for urging the holders against the panel can be designed to move the holders by a predetermined stroke regardless of the size of the panel, thus requiring only a simple structure for various panel sizes.

DETAILED DESCRIPTION OF THE PREFERRED EMBODIMENT

Figure 1:
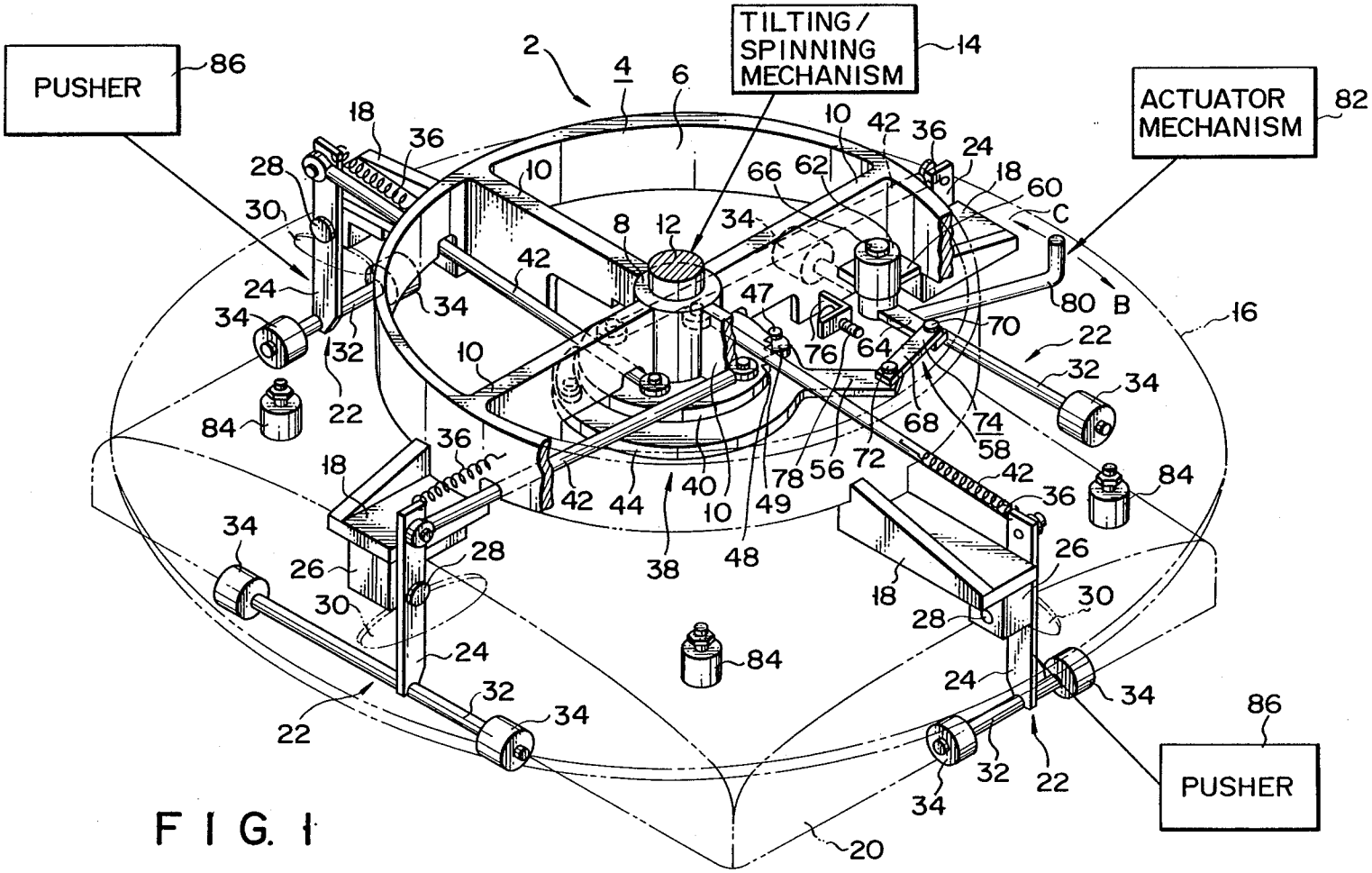
FIG. 1 is a perspective view showing a holding head of an apparatus for supporting a cathode-ray tube panel according to an embodiment of the present invention.

Reference numeral 2 in FIG. 1 denotes a holding head. Head 2 includes frame 4. Frame 4 includes annular frame portion 6 and cylindrical support portion 8 located at the center of frame portion 6. Frame portion 6 and support portion 8 are integrally coupled by four beams 10. Support portion 8 is fitted on shaft 12, and shaft 12 is tilted and spun by tilting/spinning mechanism 14.

Disk-like cover 16 is mounted on one side (:.e., the lower surface) of frame 4. Four rectangular mounting portions 18 integrally extend outward from the outer surface of frame portion 6 at equal angular intervals. Four holders 22 are respectively mounted on four mounting portions 18 to constitute two holding pairs for holding the four side surfaces of cathode-ray tube panel 20.

Each holder 22 includes pivot lever 24. The intermediate portion of each lever 24 is rotatably supported by corresponding support member 26 through corresponding rotating shaft 28. Each support member 26 is interposed between cover 16 and the external end portion of each mounting portion 18. Each pivot lever 24 can be pivoted within a plane perpendicular to cover 16. This plane includes the radial direction of cover 16. The lower half of each pivot lever 24 extends to the lower surface side of cover 16, i.e., the side opposite to frame 4, through corresponding elongated hole 30 formed in cover 16. Pivot shaft 32 is mounted at the lower end portion of each pivot lever 24. Elastic rollers 34, made of rubber or the like, are mounted on both ends of each pivot shaft 32.

Each spring 36 is hooked between the upper end of each pivot lever 24 and the corresponding outer surface position of frame portion 6. Each pivot lever 24 is biased by the biasing force of spring 36 in a direction to separate roller 34 from the corresponding side surface of panel 20.

Reference numeral 38 denotes an urging mechanism for urging rollers 34 of holders 22 against the surfaces of panels 20. Urging mechanism 38 comprises disk-like actuator 40. Actuator 40 is rotatable about the center between the two pairs of holders 22, i.e., about the central shaft fitted in support portion 8. Portions of actuator 40 deviated from its pivotal center are connected to the upper ends of pivot levers 24 through connecting rods 42, respectively. When actuator 40 is pivoted clockwise (a first direction) in FIG. 1, rollers 34 of each pair are moved to come close to each other. However, when actuator 40 is pivoted counterclockwise (a second direction) in FIG. 1, rollers 34 of each pair are moved to be separated from each other.

Disk-like lock plate 44 is concentric with actuator 40 between actuator 40 and cover 16 with respect to support portion 8 as the central axis.

Figure 2:
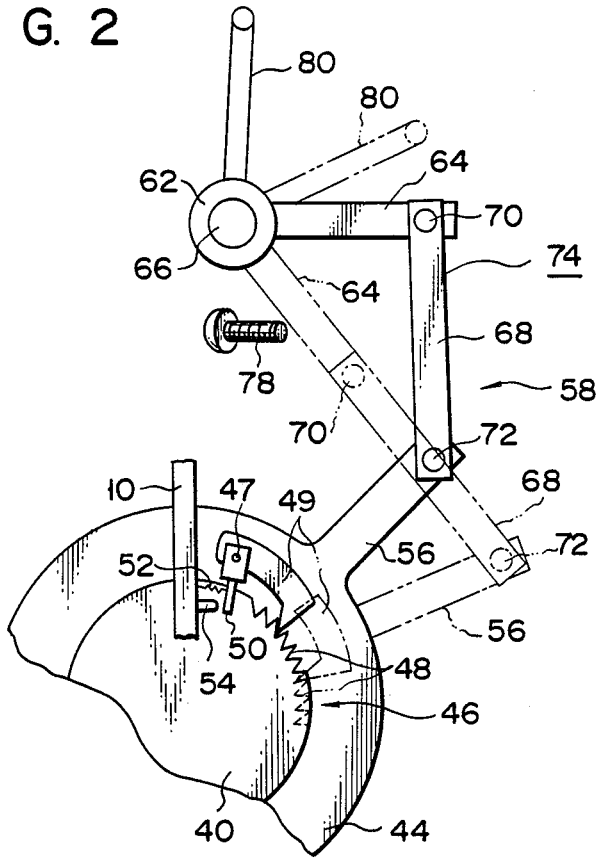
FIG. 2 is a plan view showing ratchet, lock, and release mechanisms in the holding head shown in FIG. 1.
Figure 3:
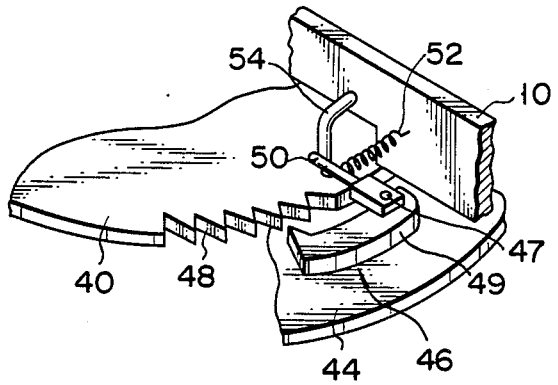
FIG. 3 is a perspective view showing the ratchet and release mechanisms shown in FIG. 1.

The direction of relative pivotal movement between actuator 40 and lock plate 44 is defined by ratchet mechanism 46, as shown in FIGS. 2 and 3. Ratchet teeth 48 are formed on the edge of actuator 40. Ratchet pawl 49 is mounted on lock plate 44 through rotating shaft 47. Lever 50 is integrally mounted on pawl 49 so as to extend inwardly of annular frame portion 6. Spring 52 is hooked between lever 50 and beam 10 located near lever 50. Pawl 49 is biased by spring 52 in a direction so as to mesh with one of ratchet teeth 48. Therefore, actuator 40 can be pivoted clockwise relative to lock plate 44 but cannot be pivoted counterclockwise relative thereto.

Ratchet release stopper 54 is mounted on beam 10 at a position opposite to the distal end portion of lever 50. When lock plate 44 is pivoted counterclockwise, lever 50 abuts against stopper 54. Ratchet pawl 49, integral with lever 50, is pivoted in a direction so as to be released from teeth 48.

Lock plate 44 has arm 56 extending outwardly from the edge thereof. Arm 56 is connected to lock mechanism 58, as shown in FIGS. 1 and 2. Lock mechanism 58 comprises hollow shaft 62 fixed inside annular frame portion 6 by connecting piece 60. Shaft 66 is rotatably fitted in hollow shaft 62 and is coupled to one end of arm 64. One end of connecting arm 68 is pivotally connected to the other end of arm 64 by connecting shaft 70. The other end of arm 68 is pivotally connected to the distal end of arm 56 by connecting shaft 72. Pivot arm 64 and connecting arm 68 constitute toggle mechanism 74. Screw 78 is threadably engaged with L-shaped connecting piece 76 located inside annular frame portion 6. Screw 78 is designed to abut against pivot arm 64 so as to define its pivot range. The position of screw 78 is adjusted to constitute a dead point where shafts 66, 70, and 72 are aligned when arm 64 abuts against screw 78. Actuator lever 80 is integrally formed with shaft 66 by welding or the like to cause actuator mechanism 82 to actuate toggle mechanism 74. When toggle mechanism 74 is displaced by actuator mechanism 82 from a position indicated by the solid line of FIG. 2 to a position indicated by the alternate long and two short dashed line of FIG. 2 by actuator lever 80, lock plate 44 is pivoted clockwise and is locked in the pivoted position. However, when toggle mechanism 74 is displaced from the position indicated by the alternate long and two short dashed line to the position indicated by the solid line of FIG. 2, lock plate 44 is pivoted counterclockwise.

Reference numerals 84 in FIG. 1 denote panel stoppers. In this embodiment, at least three panel stoppers are formed on the lower surface of cover 16 so as to prevent panel 20 from being brought into contact with the lower surface of cover 16.

Figure 4A:
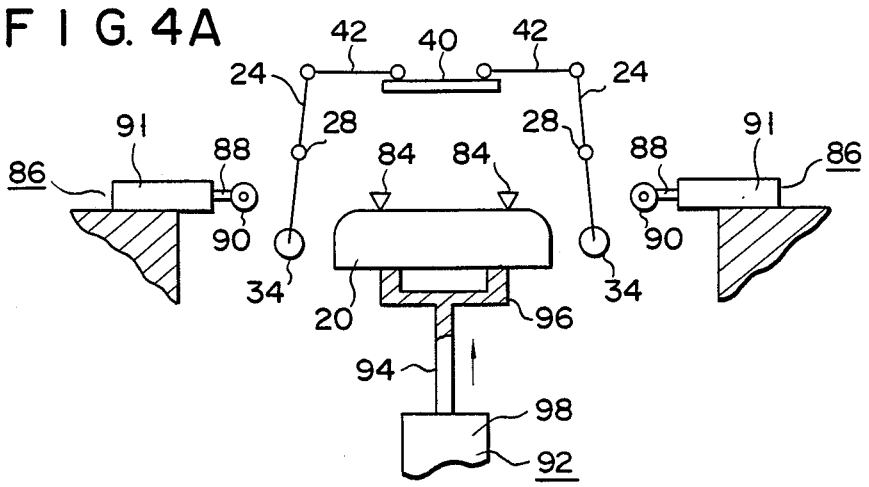
FIGS. 4A to 4C are schematic views for explaining the operation of the apparatus shown in FIG. 1.
Figure 4B:
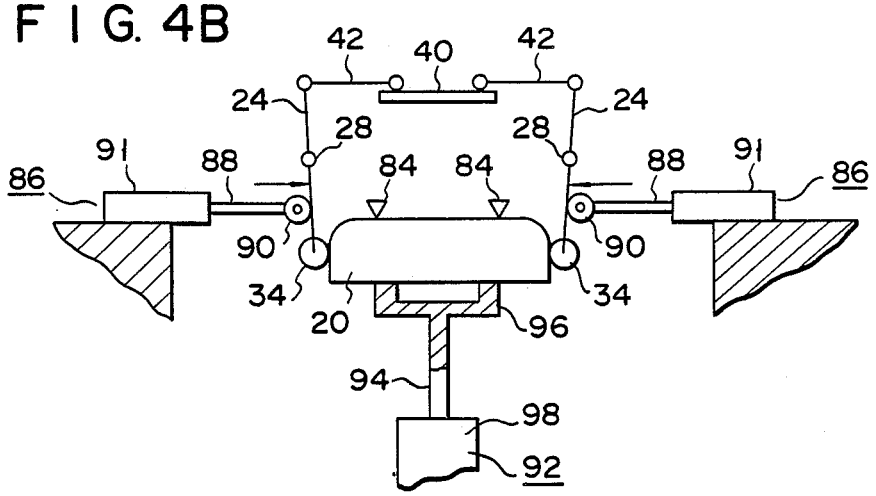
Figure 4C:
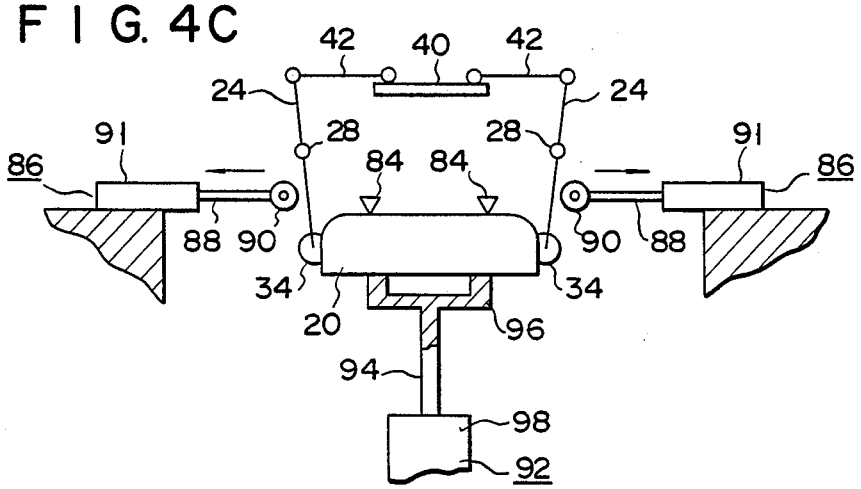

Reference numerals 86 in FIG. 1 denote a pair of pushers. As shown in FIGS. 4A to 4C, each pusher 86 comprises air cylinder 92. Each press roller 90 is mounted on the distal end of piston rod 88 of corresponding air cylinder 91. Pushers 86 move holders 22 to the surfaces after panel 20 is located between holders 22. Reference numeral 92 in FIGS. 4A to 4C denotes a lifter. Lifter 92 comprises air cylinder 98. Support 96 is mounted at the distal end of piston rod 94 of air cylinder 98. Lifter 92 serves to locate panel 20 between holders 22.

Figure 5:
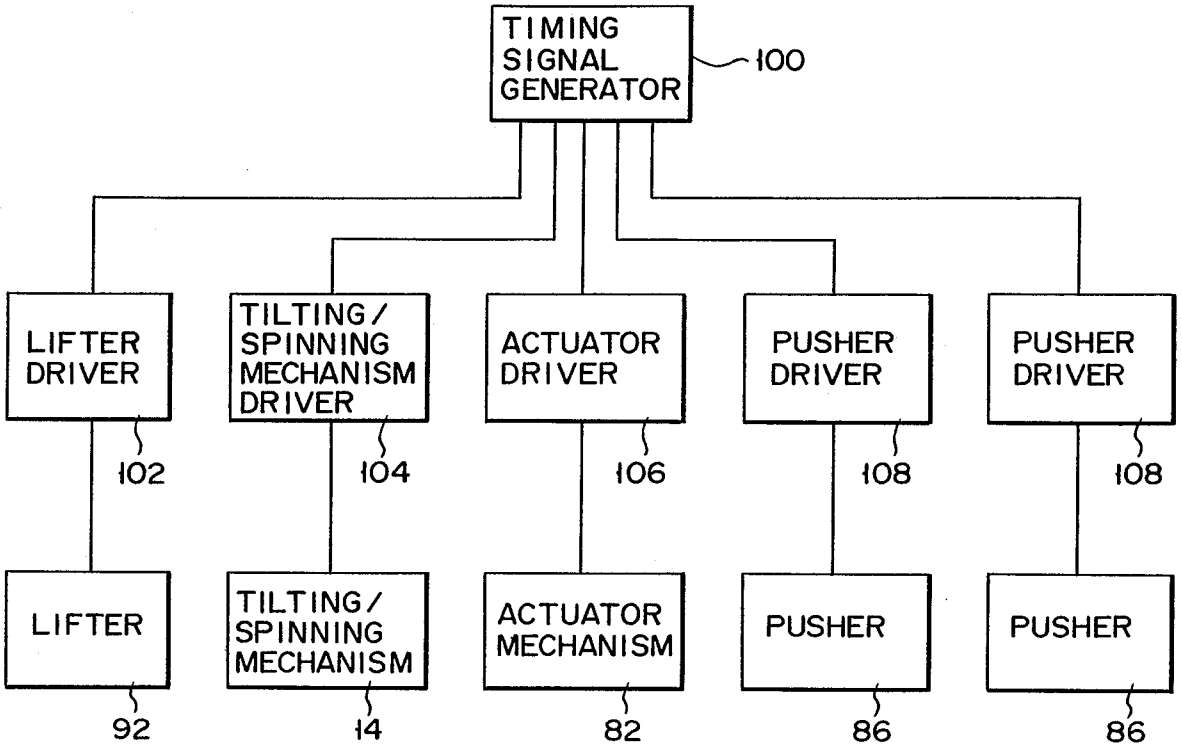
FIG. 5 is a block diagram showing functional blocks of the apparatus shown in FIG. 1.

Reference numeral 100 in FIG. 5 denotes a timing signal generator. Generator 100 supplies drive timing signals to lifter driver 102, tilting/spinning mechanism driver 104, actuator mechanism driver 106, and two pusher drivers 108.

The operation of the apparatus will be described below.

As shown in FIG. 4A, assume that rollers 34 of each pair are kept in an open state (i.e., they are kept separated from each other). In this state, when a drive start command is supplied from an input device (not shown) to generator 100, generator 100 outputs a drive start signal to lifter driver 102. Driver 102 starts driving lifter 92. Piston rod 94 of lifter 92 is moved upward until the upper surface (outer surface) of panel 20 abuts against panel stoppers 84. Piston rod 94 is then stopped at a position where panel 20 can be held by rollers 34 of holders 22.

Timing signal generator 100 then outputs a drive start signal to pusher drivers 108, and drivers 108 start driving pushers 86. Piston rods 88 of pushers 86 are moved forward to urge side portions of rollers 34 of pivot levers 24 of one of pairs of holders 22. As shown in FIG. 4B, rollers 34 are moved inward and stopped when rollers 34 are brought into contact with the corresponding side surfaces of panel 20. Actuator 40 connected to the pair of urged pivot levers 24 by connecting rods 42 is pivoted clockwise in FIG. 1. Upon pivotal movement, rollers 34 mounted on the other pair of pivot levers 24 by corresponding connecting rods 42 are moved to come close to the corresponding side surfaces of panel 20.

Thus, the rollers of either pair are moved toward each other. As a result, rollers 34 of one of the pair contact the short opposing sides of panel 20, and rollers 34 of the other pair reach positions close to the long opposing sides of panel 20.

In this case, actuator 40 is pivoted clockwise in FIG. 1. Ratchet mechanism 46 causes actuator 40 to pivot about lock plate 44. Therefore, actuator 40 is pivoted clockwise while lock plate 44 is stopped.

Timing signal generator 100 outputs a drive start signal to actuator mechanism driver 106. Driver 106 starts driving actuator mechanism 82. Actuator lever 80 is moved in the B direction (clockwise) in FIG. 1, and toggle mechanism 74 is pivoted up to the dead point. During this operation, ratchet mechanism 46 does not cause actuator 40 to pivot about lock plate 44. Therefore, actuator 40, integral with lock plate 44 through ratchet mechanism 46, is pivoted clockwise by a predetermined angle. In a closed state, the two pairs of holders 22 are further pivoted by an angle corresponding to the pivot angle of toggle mechanism 74, and rollers 34 of one pair of holders are brought into tight contact with the short side surfaces of panel 20. Rollers 34 are elastically deformed to firmly hold panel 20. When rollers 34 are in tight contact with the side surfaces, actuator mechanism 82 is stopped. In this case, since toggle mechanism 68 reaches the dead point, it is locked. Rollers 34 of the other pair of holders 22 are not brought into contact with the long side surfaces of panel 20. However, rollers 34 of the two pairs of holders 22 may be in contact with four side surfaces of the panel if the panel is so designed.

Timing signal generator 100 outputs a drive start signal to pusher drivers 108. As shown in FIG. 4C, drivers 108 cause piston rods 88 of pushers 86 to withdraw.

Timing signal generator 100 then outputs a drive start signal to lifter driver 102. Lifter driver 102 moves piston rod 94 of lift 92 downward.

In this state, phosphor coating for panel 20 is performed. Since panel 20 is firmly held by holders 22, it is not dropped during its rotation.

When panel 20 is removed from holders 22, the reverse operations are performed. Only the release operation of lock mechanism 58 will be described below.

Actuator mechanism driver 106 drives actuator mechanism 82 in response to a drive start signal from timing signal generator 100. Actuator mechanism 82 is pivoted in the C direction (counterclockwise) in FIG. 1 to move toggle mechanism 70 from a position indicated by the alternate long and two short dashed line to a position indicated by the solid line. Upon this operation, actuator 40 integral with lock plate 44 is pivoted counterclockwise to release panel 20 from holders 22. In this case, counterclockwise pivotal movement of lock plate 44 and actuator 40 causes lever 50 to abut against stopper 54, and lever 50 together with ratchet pawl 49 is pivoted counterclockwise to release the meshing of pawl 49 from ratchet teeth 48. In this state, actuator 40 can be freely rotated relative to lock plate 44. The two pairs of holders 22 are opened (i.e., each pair of holders are separated from each other) by the biasing forces of springs 36 in a state shown in FIG. 4A. Panel 20 is moved on support 96 of lifter 92.

As described above, ratchet mechanism 46 and lock mechanism 74 cause actuator 40 to pivot through a predetermined angle from a position where rollers 34 of holders 22 are in contact with the side surfaces of panel 20 and allow locking of actuator 40 at the pivoted position. For this reason, pivot levers 24 of the two pairs of holders 22 interlocked with actuator 40 can be locked at any angular position. Within the pivotal range of levers 24, panel 20 can be properly held, regardless of different sizes. The holding sequences are identical even if panels having difference sizes are to be held. Unlike in the conventional apparatus, different holding sequences for different panel sizes need not be performed, or a panel support apparatus designed for a specific panel size need not be used. Therefore, panels 20 having different sizes can be manufactured in a single production line. Furthermore, the holding pressure acting on panel 20 is determined by the pivotal angle of lock mechanism 58, i.e., toggle mechanism 74. Therefore, a predetermined pressure can always act on panels having different sizes. Since the numbers of levers, pivot shafts, lock members, and the like are small, a compact lightweight holding apparatus can be designed. In addition, operability of the apparatus can be improved and maintenance procedures can be simplified.

Figure 6:
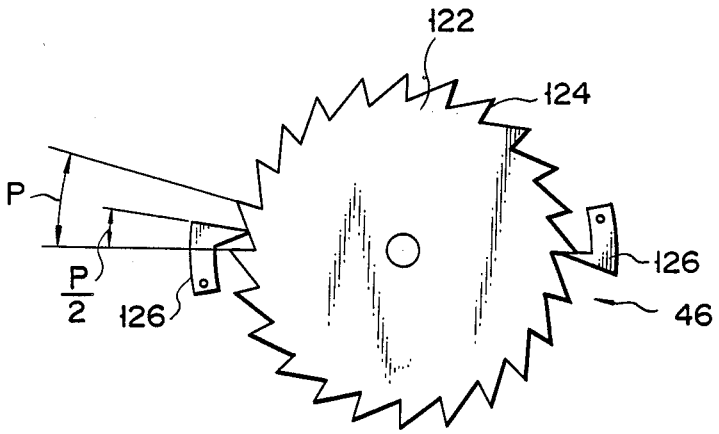
FIG. 6 is a plan view showing a modification of the ratchet mechanism constituted by a one-way clutch.

FIG. 6 shows a modification of ratchet mechanism 46. In this modification, two ratchet pawls 126 can engage with one actuator 122. Ratchet pawls 126 are offset by p/2 (where p is a pitch of teeth 124) with respect to the central axis of actuator 122. With this structure, a stabler holding force can be generated.

Figure 7:
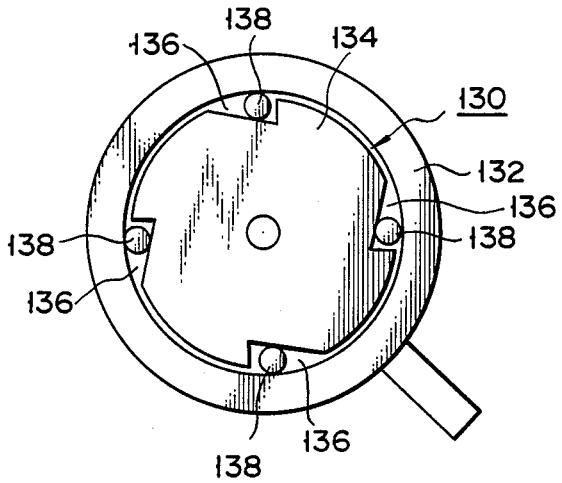
FIG. 7 is a plan view showing another modification of the one-way clutch.

Roller clutch 130 shown in FIG. 7 may be used in place of ratchet mechanism 46 as a one-way clutch. Actuator 134 is disposed inside annular lock plate 132. Wedge-shaped notches 136 are formed on the edge of actuator 134. Rollers 138 are located in notches 136, respectively. Clockwise pivotal movement of actuator 134 relative to lock plate 132 is prevented by the above mechanism, and counterclockwise movement thereof is allowed. The type of one-way clutch is not limited to a specific one as long as it allows only one-way rotation of the actuator.

What is claimed is:

1. An apparatus for supporting individual cathode-ray tube panels having different sizes and surfaces which face each other, comprising:

a pair of holders adapted to come close to each other and to be separated from each other;

transporting means for positioning the panel between said pair of holders;

moving means for moving said pair of holders to the surfaces after the panel is moved to a position between said pair of holders by said transporting means;

urging means for moving said pair of holders, which have been moved to the surfaces by said moving means, to come close, to each other by a predetermined distance regardless of the size of the panel, thereby urging said pair of holders against the surfaces of the panel and hence causing said pair of holders to hold the panel said urging means including:

an actuator pivoted in a first direction in a synchronism with closing movement of said pair of holders and in second direction in synchronism with opening movement thereof, said actuator being adapted to move said pair of holders so that said pair of holders come close to each other upon a pivotal movement of said actuator in the first direction, and said actuator being adapted to move said pair of holders so that said pair of holders are separated from each other upon a pivotal movement of said actuator in the second direction;

a pivotal member concentric with said actuator;

one-way pivot regulating means for allowing pivotal movement of said actuator in the first direction relative to said pivot member and for inhibiting pivotal movement of said actuator in the second direction relative to said pivot member;

a lock mechanism movably disposed between first and second positions, said lock mechanism being adapted to pivot said pivot together with said actuator through said one-way pivot regulating means by a predetermined angle in the first direction and to maintain the predetermined angle in the first position when said lock mechanism is moved from the first position to the second position, and said lock mechanism being adapted to pivot said pivot member together with said actuator by said one-way pivot regulating means in the second direction when said lock mechanism is moved from the second position to the first position; and releasing means for releasing said actuator from said pivot member by said one-way pivot regulating means so as to allow said actuator to pivot in the second direction when said lock mechanism is moved from the second position to the first position and said pivot member together with said actuator is pivoted by the predetermined angle in the second direction by said one-way pivot regulating means.

2. The apparatus according to claim 1, wherein said lock mechanism comprises a toggle mechanism.

3. The apparatus according to claim 2, said pivot member comprises a center of pivot movement and a portion eccentric from the center of pivot movement, and said toggle mechanism comprises a pivot arm having a center of pivot movement and a portion eccentric from the center of pivot movement of said pivot arm and a connecting arm connecting said portion of the pivot arm to said portion of the pivot member, the center of pivot movement and the portion eccentric therefrom of said pivot arm and said portion of said pivot member being aligned in the second position.

4. The apparatus according to claim 1, wherein said one-way pivot regulating means comprises a one-way clutch.

5. The apparatus according to claim 4, wherein said one-way clutch comprises ratchet teeth formed on an edge of said actuator, a ratchet pawl pivotally mounted on said pivot member, and ratchet pawl biasing means for biasing said ratchet pawl in a direction to allow said ratchet pawl to be engaged with said ratchet teeth.

6. An apparatus for supporting individual cathode-ray tube panels having different sizes and surfaces that face each other, comprising:

a pair of holders adapted to come close to each other and to be separated from each other;

transporting means for positioning the panel between said pair of holders;

moving means for moving said pair of holders to the surfaces after the panel is moved to a position between said pair of holders by said transporting means;

urging means for moving said pair of holders, which have been moved to the surfaces by said moving means, to come close to each other by a predetermined distance regardless of the size of the panel, thereby urging said pair of holders against the surfaces of the panel and hence causing said pair of holders to hold the panel, said urging means including:

actuating means initially positioned when said holders are moved by said moving means to said position on said surface and which is adapted to be further moved to cause said holders to move said predetermined distance wherein said actuating means rotates when said moving means brings said holders to said position to cause said initial positioning and which further rotates when caused to be moved further.

7. An apparatus according to claim 6 wherein the direction of rotation of said actuating means corresponds to the opening or closing of said holders, said closing corresponding to a first direction and said opening corresponding to a second direction.

8. An apparatus according to claim 7 further including:

means for restricting the direction of said rotation to only said first direction; and means for releasing said restricting means when said holders are ready to be opened.

* * * * *